US005337835A

United States Patent [19]

Bohne et al.

[11] Patent Number: 5,337,835

[45] Date of Patent: Aug. 16, 1994

[54] DRILL AND/OR IMPACT HAMMER

[75] Inventors: Ulrich Bohne, Kohlberg; Wilfried Kabatnik, Leinf-Echterd; Manfred Bleicher, Leinfelden-Echterdingen; Joachim Hecht, Magstadt; Justus Lamprecht, Dusslingen, all of Fed. Rep. of Germany

[73] Assignee: Robert Bosch GmbH, Stuttgart, Fed. Rep. of Germany

[21] Appl. No.: 83,682

[22] Filed: Jun. 25, 1993

[30] Foreign Application Priority Data

Sep. 24, 1992 [DE] Fed. Rep. of Germany ..... 4231986

[51] Int. Cl.[5] ..... B25D 11/10

[52] U.S. Cl. ..... 173/13; 173/48; 173/109

[58] Field of Search ..... 173/47, 48, 13, 109, 173/117

[56] References Cited

U.S. PATENT DOCUMENTS

| | | | |
|---|---|---|---|
| 4,284,148 | 8/1981 | Wanner et al. | 173/109 |
| 4,325,436 | 4/1982 | Richter et al. | 173/13 |
| 4,529,044 | 7/1985 | Klueber et al. | 173/48 |
| 4,750,567 | 6/1988 | Grossmann et al. | 173/13 |
| 5,036,925 | 8/1991 | Wache | 173/48 |
| 5,159,986 | 11/1992 | Hoser | 173/48 |

FOREIGN PATENT DOCUMENTS

| | | | |
|---|---|---|---|
| 3931329 | 6/1990 | Fed. Rep. of Germany | 173/48 |
| 4121279 | 7/1993 | Fed. Rep. of Germany . | |

*Primary Examiner*—Rinaldi I. Rada
*Attorney, Agent, or Firm*—Michael J. Striker

[57] ABSTRACT

An impact hammer has a housing, a motor accommodated in the housing, an impacting mechanism accommodated in the housing and having a driver and a striker which is displaced by the driver in an axial direction and periodically strikes a shaft of a tool with the driver being tiltable about a tilting axis, a driving element which drives the driver into a reciprocating motion and a shaft which rotates the driving element. The driving element is provided with two interengaging eccentric parts including a first eccentric part which is non-rotatably connected with the shaft and a second eccentric part which is axially displaceable relative to the shaft. The eccentric parts have ring surfaces each surrounding the shaft, arranged asymmetrically relative to one another and being in contact with one another. The ring surfaces are offset relative to the one another so that a resulting eccentricity of the driving element relative to the shaft, which eccentricity acts on the driver, is adjustable between zero and a maximal value.

10 Claims, 6 Drawing Sheets

DRILL AND/OR IMPACT HAMMER

BACKGROUND OF THE INVENTION

The present invention relates to a drill hammer, an impact hammer or a drill-impact hammer.

More particularly, it relates to a hammer which has a housing, a motor arranged in the housing, and an impact mechanism with a striker driven by a driving member and acting periodically directly or indirectly on the shaft of a tool, wherein the driver member is tiltable about a tilting axis and driven from a drive with an eccentric rotatable by a shaft.

Drill and/or impact hammers of the above mentioned general type are known in the art. One of such drill and/or impact hammers is disclosed for example in the German document DE 41 21 279 A1. In this hammer the impact mechanism is coupled through a claw coupling with an idle running device controlled by the tool. The claw coupling connects a stationary part with a rotatable part, which leads to wear and increased working noise.

SUMMARY OF THE INVENTION

Accordingly, it is an object of the present invention to provide a drill and/or impact hammer which avoids the disadvantages of the prior art.

In keeping with these objects and with others which will become apparent hereinafter, one feature of the present invention resides, briefly stated, in a drill and/or impact hammer of the above mentioned type, in which the driving element has two interengaging eccentric parts including a first eccentric part which is non-rotatably connected with the shaft and a second eccentric part which is axially displaceable relative to the shaft, both eccentric parts provided with ring surfaces which surround the shaft, are arranged asymmetrically relative to the shaft and are in contact with one another, and the ring surfaces are offset relative to one another, so that the resulting eccentricity of the driving element relative to the shaft acting on the driver is adjustable between zero and a maximum value.

When the drill and/or impact hammer is designed in accordance with the present invention, the coupling parts which are to be connected with one another have the same rotary speed. The parts remain always in engagement with one another and only rotate or displace relative to one another. This leads to a noiseless coupling process without wear.

In accordance with another feature of the present invention, the driver is in constant engagement with the driving element.

Also, in accordance with further features of the present invention, the second eccentric part can be axially displaceable along the ring surface of the first eccentric part. The ring surfaces can extend coaxially relative to the axis of the shaft and can be formed as cylindrical casings.

In accordance with still another feature of the present invention, the second eccentric part can be guided on a curve path and turned during the axial displacement along the shaft relative to the first eccentric part. The curved path can be helical and arranged in of the eccentric parts. On the other hand, both eccentric parts can be provided with cooperating curved paths.

The ring surfaces can be inclined relative to the axial direction of the shaft. They can be also non-round.

Finally the driving element can have a passage for engaging of the driver, and the driver can have a shape of a truncated cone and both sides, so that in each possible eccentric position of the driving element, the driver contacts ideally on two lines of the passage without play.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
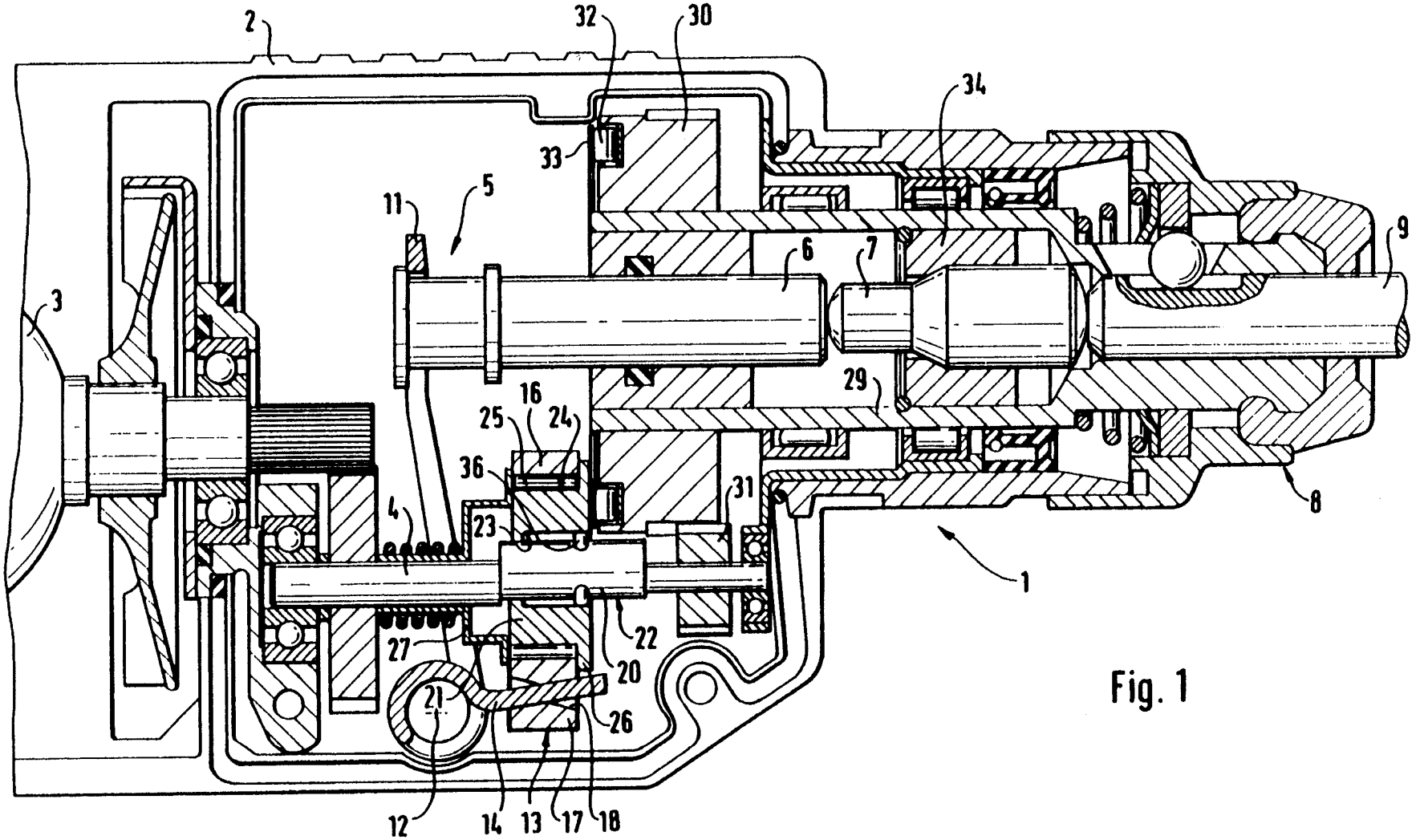
FIG. 1 is a view a longitudinal section of a drill hammer in accordance with the present invention.

FIG. 1 shows a section of a drill hammer 1 with a housing 2 and a motor 3 located behind it. The motor 3 drives an impact mechanism 5 through a shaft 4. The impact mechanism has a striker 6 which acts through an anvil 7 onto a tool 9 which is received in a tool receptacle 8. The striker 6 is reciprocatingly driven by a spring driver 11. The driver is supported tiltably about a tilting axis 12 and has a lever 14 which is coupled with a driving element 13.

The driving element 13 includes a coupling sleeve 16 provided with a downwardly extending projection 17 having a passage 18. The passage 18 is formed so that its surfaces which faces the lever 14 have the shape of truncated cones at both sides with elliptic base surface. Due to this construction, the lever 14 in each possible eccentric position of the driving element 13 is guided without play so that above and below it contacts ideally along each geometrical line of the passage 18.

The important feature of the drive is that it has two eccentric parts 20 and 21 which are limitedly turnable relative to one another and abut against one another or engage in one another. These parts include an inner eccentric part 20 which is fixedly connected with the shaft 4 or formed of one piece with it. The inner eccentric part 20 has an outer ring surface 22 which is cylindrical and extends axis-parallel and at the same time eccentrically with the regard to the rotational axis of the shaft 4. An outer eccentric part 21 has a ring surface 23 which engages the ring surface 22 from outside and is also axis-parallel and eccentric to the axis of the rotational shaft 4. The ring surface 23 is also eccentric to a peripheral surface 24 of the eccentric part 21 on which the coupling sleeve 16 is rotatably supported via a needle bearing 25. The coupling sleeve 16 is secured by a collar 26 on the eccentric part 21 and a spring loaded spacing sleeve 27 which forces the whole driving element 13 forwardly in direction toward the tool receptacle 8.

A hammer tube 29 which is fixedly connectable with the tool holder 8 and is axially limitedly displaceable, extends close to the eccentric part 21. A toothed gear 30 for a rotary drive is fixedly connected with it and engages with a second toothed gear 31 arranged on the shaft 4. The toothed gear 30 at its end facing the eccentric part 21 has an axial bearing 32 which is in contact with the collar-side end surface of the eccentric part 21 with interposition of a disc 33. The anvil which reduces toward the striker 6 is guided in a guiding sleeve 34 with an opening which reduces also toward the striker so that, during pressing of the tool against the anvil 7 the hammer tube 29 is displaced in direction toward the eccentric part 21.

Figure 2:
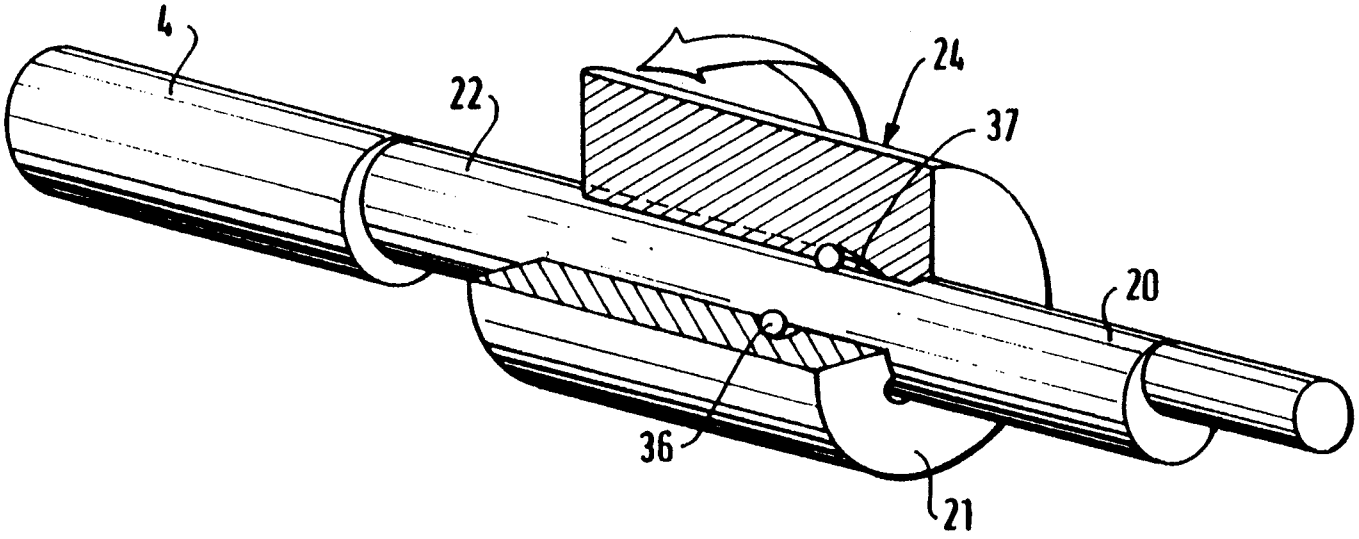
FIG. 2 is a perspective view of the drill hammer shown in FIG. 1.

FIG. 2 shows the shaft 4 with two eccentric parts 20 and 21. Two-four short guiding pins are inserted in the ring surface 22 of the inner eccentric part 20 and uniformly distributed over the periphery. They engage in associated helical curved or cam paths 37 in the ring surface 23 of the outer eccentric part 21. In FIG. 2 the guiding pins 36 abut against the left end of the associated curved path 37. The eccentric part 21 is located in the rotary position, in which the eccentricities of both parts 20 and 21 are identical. Thereby the peripheral surface 24 runs round with regard to the axis of the shaft 4.

When the tool 9 is firmly pressed on a working location as shown in FIG. 1 the outer eccentric part 21 abuts against the abutment on the spacing sleeve 27, so that it can no longer displace or turn relative to the inner eccentric part 20. The total eccentricity of the driving element 13 produced by both eccentric parts 20 and 21 reaches now its maximum value. In other words the lever 14 of the driver 11 reciprocates with a maximal amplitude. Thereby the striker 5 is adjusted to maximal impact intensity.

When the tool 9 is pressed less strong, the eccentric part 21 is moved a little to the right relative to the eccentric part 20. It turns forcedly along the curved paths 37 relative to the inner eccentric part 20, and the total eccentricity is reduced. When the tool 9 is completely withdrawn from the workpiece, the outer eccentric part 21 moves under the action of the pressure of the spring-loaded spacing sleeve 27 to its front end position as shown in FIG. 2. Since the total eccentricity of the driving element 13 is zero, the coupling sleeve 16 is stopped without abutment and the lever 14. The impact mechanism is thereby turned off.

Figure 3:
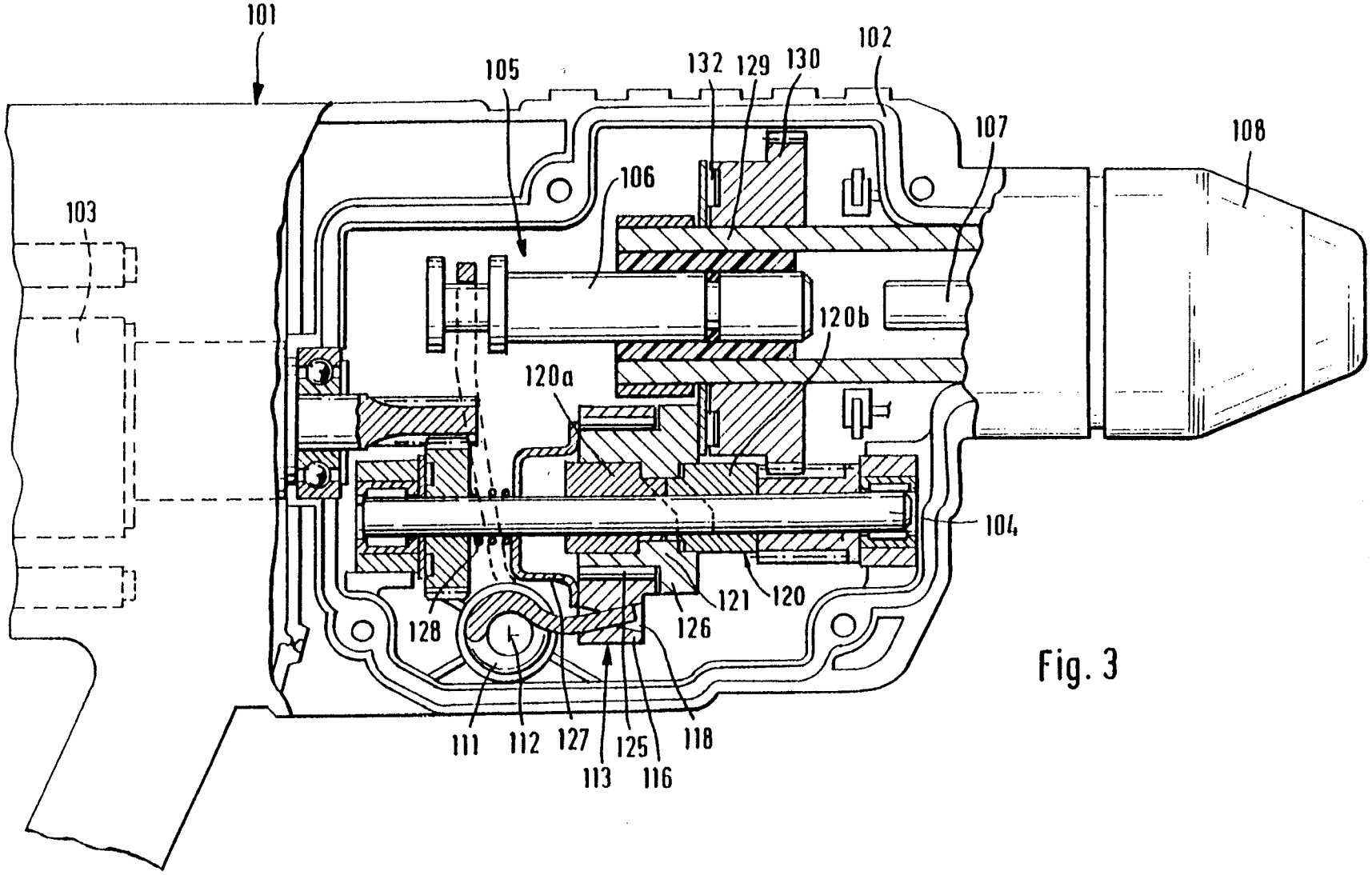
FIG. 3 is a view showing a longitudinal section of a hammer in accordance with a second embodiment of the invention.

The hammer in accordance with the second embodiment of FIGS. 3 to 6 is in principle formed similar to the hammer of the first embodiment. The parts shown in FIG. 3 are identified with reference numerals increased by 100. Those parts which are not mentioned correspond go the parts of the first embodiment.

A driving element 113 surrounds an inner eccentric part 120 which is composed for mounting reasons of two members 120*a* and 120*b*. These members are not displaceable relative to one another in operation and fixedly connected, for example by welding or pressing-on with the shaft 104. The eccentric part 120 has an eccentric outer ring surface 122, on which an inner ring surface 123 of an outer eccentric part 121 abuts, as can be seen from FIGS. 4–6. A coupling sleeve 116 is rollingly supported on an outer peripheral surface 124 of the eccentric part 121 as in the first embodiment, and abuts against a collar 126. A driver 111 engages in a known manner in a passage 118 of the coupling sleeve 116, which passage has inner surfaces formed as truncated cones.

Figure 7:
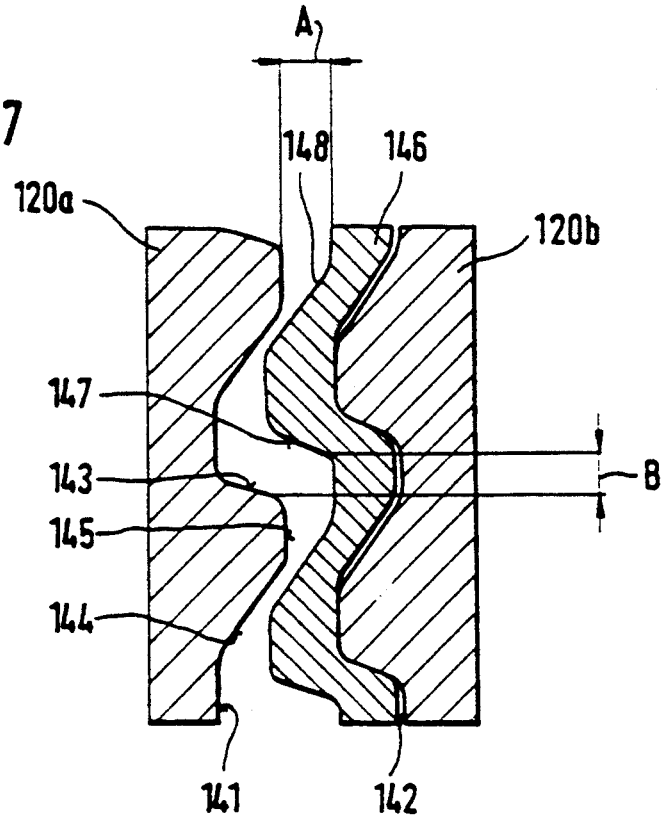
FIGS. 7 and 8 in the development show schematically the functions of the individual parts.
Figure 8:
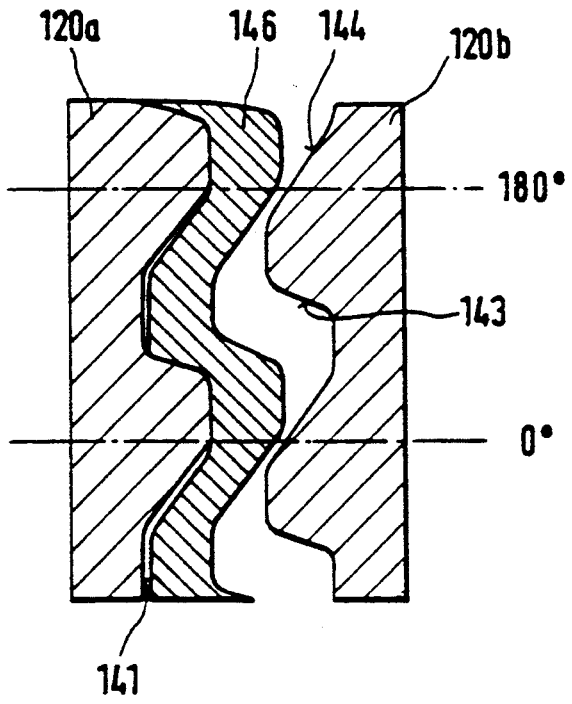

The inner eccentric part 120 is provided in its central region with a circular groove 140 which is limited by two curves paths 141 and 142 (see the development in FIGS. 7 and 8). The curved path 141 and 142 have the shape of saw teeth each provided with a steep flank 143 and a flat flank 144 per each tooth 145. The curved paths 141 and 142 have coinciding courses, however, they are offset in a circumferential direction. A ring shaped strip 146 which also has a profile of saw teeth engages with play in the groove 140 and extends back inwardly from the outer eccentric part 121. It also has local steep portions 147 and local flat portions 148. The outer eccentric part 121 as in the first embodiment, is axially displaceable. A toothed gear 130 mounted a hammer tube 129 abuts against the eccentric part 121 with its axial bearing 132.

Figure 4:
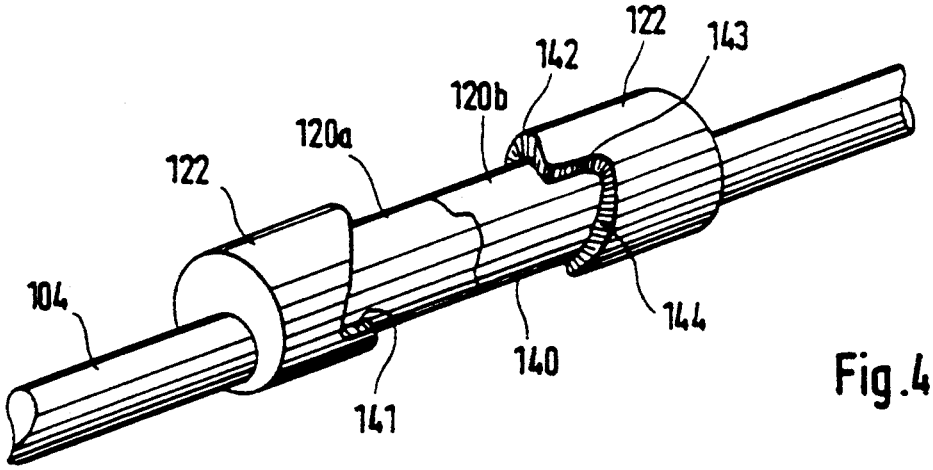
FIGS. 4, 5 and 6 are perspective views of eccentric parts of the inventive hammer.
Figure 5:
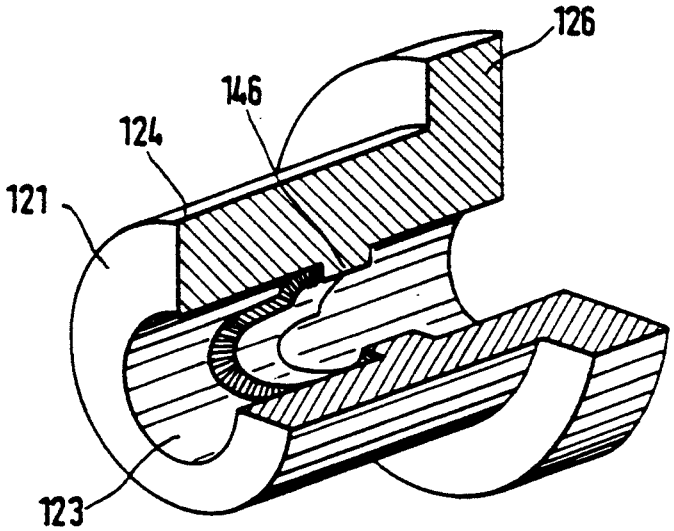
Figure 6:
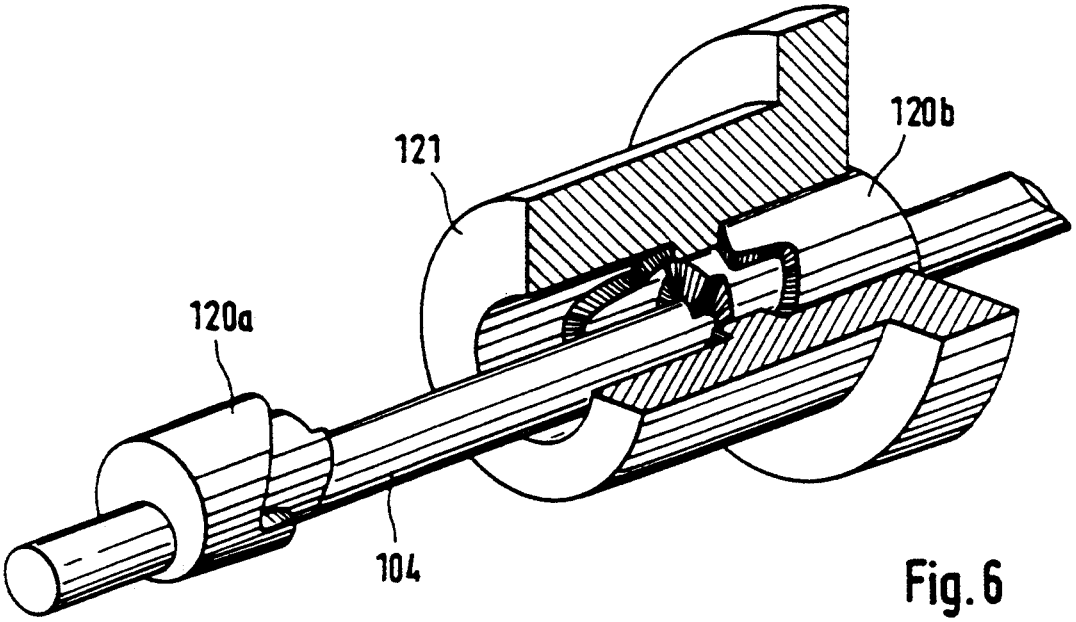

The eccentric parts 120 and 121 are shown in detail in FIGS. 4–6. In FIG. 6 the eccentric part 120*a* is shifted to the left for clarity.

The operation of the impact coupling composed of the eccentric parts 120 and 121 is illustrated clearly in FIGS. 7 and 8.

FIG. 7 shows an uncoupled condition in which the strip 146 of the outer eccentric part 121 abut on the eccentric member 120*b*. When the tool of the drill hammer 101 is pressed against a workpiece, the outer coupling part 121 is displaced rearwardly from the toothed gear 130, or in other words to the left in FIGS. 3, 7 and 8. The flat portions 148 of the strip 146 strike against the flat flanks 144 of the eccentric member 120*a*. They slide on one another so that the eccentric part 121 is turned relative to the eccentric 120 by the value B. At the end of the switching process, the strip 146 abuts against the curved path 141 of the eccentric member 120*a* as shown in FIG. 8, and the steep flanks form corresponding abutment which prevent further turning of the eccentric parts 120 and 121 relative to one another. Now the coupling is completely coupled, or in other words, the total eccentricity reaches its maximum value. This operational condition is shown in FIG. 3.

When the hammer is again removed from the working location, the spring 128 presses the eccentric part 121 through the spacing sleeve 127 forwardly or to the right in FIG. 3. Simultaneously, the eccentric part 121 is turned back into contact with the eccentric member 120*b* and the total eccentricity comes to zero.

Figure 9:
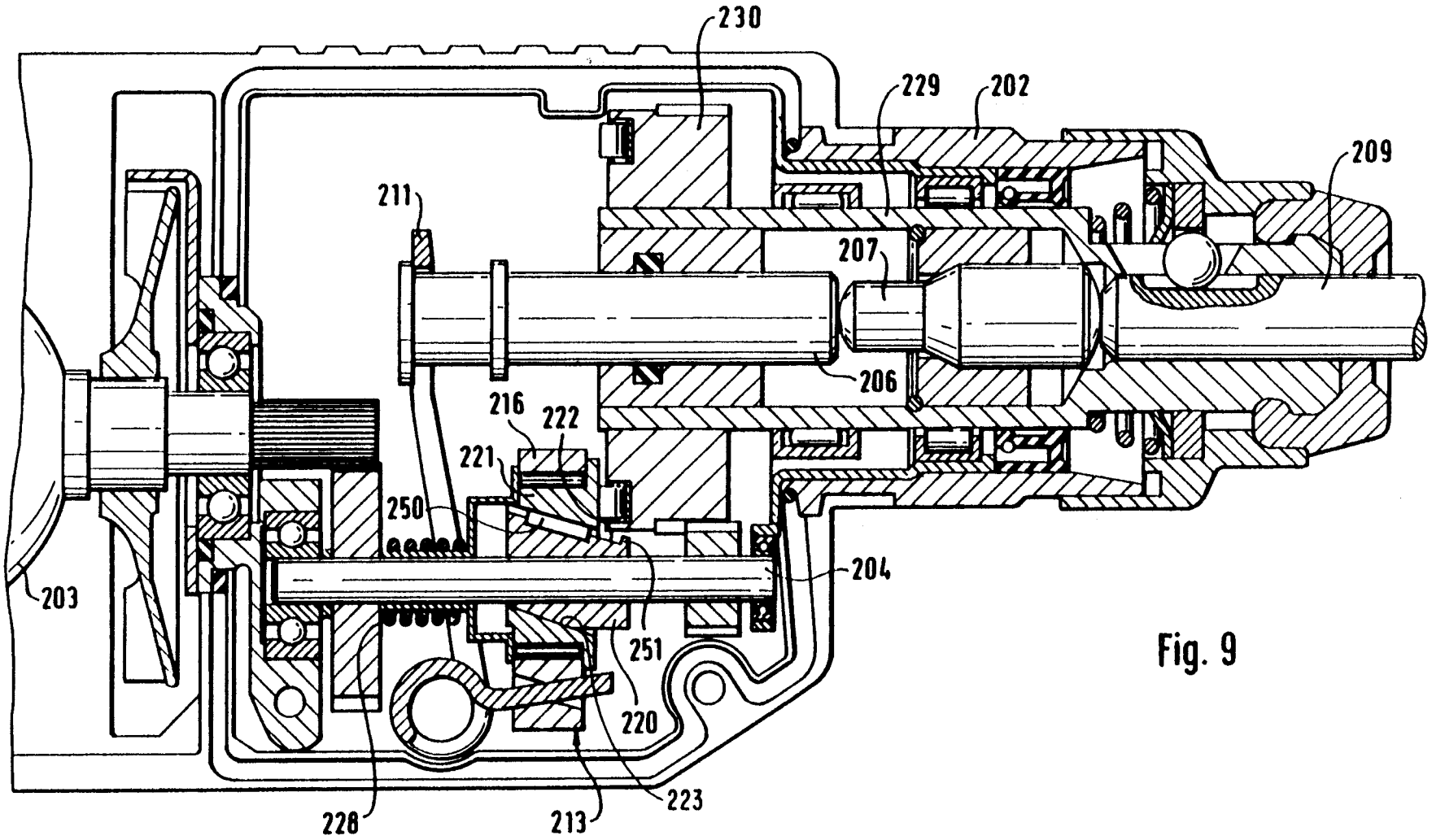
FIG. 9 shows a third embodiment of the hammer in accordance with the present invention.

The hammer in accordance with the third embodiment shown in FIG. 9 is formed in principle as the hammers of the previous embodiments. The parts which of this embodiment which correspond to the parts of the first embodiment are identified with reference numerals increased by 200. Since in the third embodiment only the driving element 213 is different from the driving element of the first embodiment, the description of the third embodiment is limited to this specific feature.

An inner eccentric part 220 is arranged on a shaft 204. It has a cylindrical ring surface 222 which is inclined relative to the axis of the shaft 204. An outer eccentric part 221 abuts with its inner ring surface 223 against the ring surface 222. Both eccentric parts 220 and 221 are secured against relative turning by a wedge 250. The inner eccentric part 220 carries at the right side an abutment 251 against which the outer eccentric part 221 abuts with the eccentricity equal zero. The outer eccentric part 221 is pressed during the impact operation by the toothed gear 230 rearwardly in direction of the motor 203. In this position the total eccentricity of the driving element 213 is maximal. When the drill hammer is removed from the working location, the outer eccentric part 221 is displaced forwardly by the spring 228, and due to the inclinedly extending ring surfaces 222 and 223 the eccentricity gradually reduced to zero. The ring surfaces 222 and 223 can be not only cylindrical, but also not round such as for example four cornered or can be provided with another profile. In this case wedge 250 can be dispensed with.

The impact mechanism coupling suitable when needed also for rotary speed-independent control of the density of the individual impacts. Depending on the pressing force of the machine against the working location, the total eccentricity changes and the deflection of the driving element changes as well. A lower deflection leads to a lower intensity of the individual impacts.

It will be understood that each of the elements described above, or two or more together, may also find a useful application in other types of constructions differing from the types described above.

While the invention has been illustrated and described as embodied in a drill and/or impact hammer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An impact hammer, comprising a housing; a motor accommoted in said housing; an impacting mechanism accommodated in said housing and having a driver and a striker which is displaced by said driver in an axial direction and periodically strikes a shaft of a tool, said driver being tiltable; a driving element driving said driver into a reciprocating motion; and a shaft which has a rotational axis and rotates said driving element, said driving element having two interengaging eccentric parts including a first eccentric part which is connected with said shaft for joint rotation with said shaft and a second eccentric part which is axially displaceable relative to said shaft, said eccentric parts having ring surfaces which are in contact with one another, said ring surfaces having a common axis which is radially offset relative to said rotational axis of said shaft, said second eccentric part having an outer peripheral surface having an axis which is radially offset relative to said common axis of said ring surfaces, said axis of said outer peripheral surface of said second eccentric part determining a resulting eccentricity of said driving element relative to said shaft, which eccentricity acts on said driver, said second eccentric part being displaceable relative to said first eccentric part so as to adjust said resulting eccentricity.

2. An impact hammer as defined in claim 1, wherein said resulting eccentricity is adjustable to zero.

3. An impact hammer as defined in claim 1, wherein said common axis of said ring surfaces of said eccentric parts extend parallel with regard to an axis of said shaft.

4. An impact hammer as defined in claim 1, wherein said ring surfaces of said eccentric parts are cylindrical.

5. An impact hammer as defined in claim 1; and further comprising means forming a curved path, said second eccentric part being guided on said curved path and turned relative to said first eccentric part during an axial displacement along said shaft.

6. An impact hammer as defined in claim 5, wherein said curved path is helical and provided in one of said eccentric parts.

7. An impact hammer as defined in claim 5, wherein each of said eccentric parts is provided with said curved path arranged so that said curved paths of said eccentric parts cooperate with one another.

8. An impact hammer as defined in claim 1, wherein said common axis of said ring surfaces of said eccentric parts are inclined relative to said rotational axis of said shaft.

9. An impact hammer as defined in claim 8, wherein said ring surfaces of said eccentric parts are not round.

10. An impact hammer as defined in claim 1, wherein said driving element has a passage for engaging said driver, said passage being formed at both sides as a truncated cone said in each possible eccentric position of said driving element ideally contacting two lines of said passage in play-free manner.

* * * * *